United States Patent [19]

Van Gompel

[11] 4,241,595

[45] Dec. 30, 1980

[54] ROTO LOCK

[75] Inventor: James Van Gompel, Fremont, Ind.

[73] Assignee: Brammall, Inc., Angola, Ind.

[21] Appl. No.: 35,693

[22] Filed: May 3, 1979

[51] Int. Cl.[3] ..... E05B 35/06

[52] U.S. Cl. ..... 70/347; 70/412

[58] Field of Search ..... 70/259, 290, 395, 396, 70/397, 398, 412, 32, 33, 34, 346, 347, 133; 292/57-60

[56] References Cited

U.S. PATENT DOCUMENTS

| | | | |
|---|---|---|---|
| 1,175,946 | 3/1916 | Foster | 70/412 |
| 3,431,756 | 3/1969 | Fennell | 70/259 |
| 3,854,312 | 12/1974 | Van Gompel | 70/412 |

*Primary Examiner*—Robert L. Wolfe

*Attorney, Agent, or Firm*—Hill, Van Santen, Steadman, Chiara & Simpson

[57] ABSTRACT

An improved bolt mechanism for use in a rotary lock has a fixed transverse pin and a spring biased movable transverse pin. The movable pin may be retracted within the body of the bolt under the action of a key inserted into the lock. The protrusion mechanism comprises a shaft inside the bolt a portion of which is conical. A conical member is likewise attached to the spring biased transverse pin cooperating with the conical member of the shaft thereby allowing the external end of the transverse pin to be moved flush with the external surface of the bolt or to extend transversely therefrom. When the movable pin extends transversely from the bolt, the bolt is retained between key plates in the lock. When the movable pin is retracted, the bolt may be moved longitudinally along its axis through the key plates to unlock the lock.

9 Claims, 4 Drawing Figures

ROTO LOCK

BACKGROUND OF THE INVENTION

1. Field of the Invention

The invention relates to the field of lock mechanisms. In particular it relates to a lock having a rotary bolt which must be rotated to different angular positions as it is slid longitudinally from the locked to the unlocked position.

2. The Prior Art

Rotary locks are known in the prior art and a typical example of such lock is disclosed in U.S. Pat. No. 3,854,312 entitled "Rotary Lock" which issued Dec. 17, 1974. The disclosure and drawings of U.S. Pat. No. 3,854,312 are hereby incorporated by reference.

SUMMARY OF THE INVENTION

The invention comprises an improved bolt mechanism for use with a rotary lock. The bolt mechanism has a fixed transverse pin and a movable, spring biased, transverse pin. Retraction means internal to the bolt cooperates with a conventional unlocking key to retract the movable transverse pin. The retraction means is mounted in a longitudinal boring within the bolt and comprises a compression spring, a cylindrical member with one end having a tapered surface and a shaft connected between the cylindrical member and a threaded boring at the end of the bolt into which the unlocking key is inserted. The movable, spring biased, transverse pin has a tapered surface interior to the bolt which cooperates with the tapered surface of the cylindrical member to retract or extend that pin.

When the key is inserted into the keyway of the lock housing the shaft and the cylindrical member with the tapered surface are driven in a first direction. The tapered surface of the movable transverse pin slides past the tapered surface of the cylindrical member. The movable spring biased transverse pin retracts substantially within the bolt due to the biasing spring. The bolt may then be rotated so that the fixed transverse pin passes through keyways in lock plates within the lock thereby allowing the bolt to be retracted. The bolt may be relocked by removal of the key which in turn permits the compression spring to drive the cylindrical member and connected shaft opposite to the first direction. The tapered surface of the movable spring biased transverse pin slides up the tapered surface of the cylindrical member thereby extending the movable transverse pin relocking the bolt.

Additional security may be achieved by using a removable cylinder lock to close the entrance to the keyway to unauthorized persons.

DESCRIPTION OF THE PREFERRED EMBODIMENTS

Figure 1:
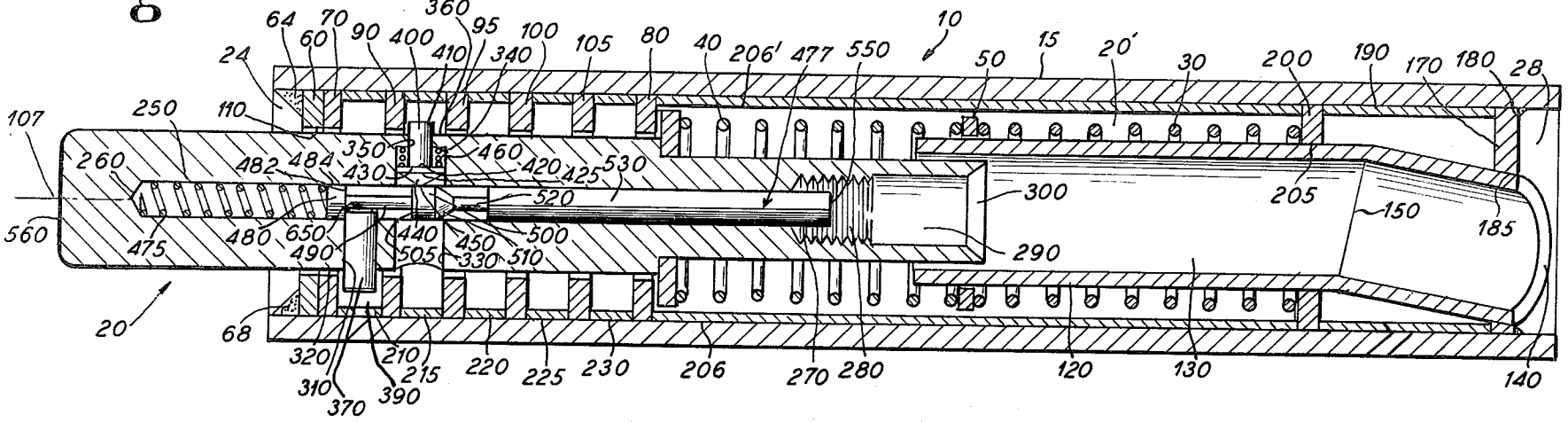
FIG. 1 is a lateral section illustrating the lock housing and the improved bolt mechanism of the present invention.

While the principles of the present invention find a particular utility in a rotary lock it will be understood that the improved bolt mechanism of the present invention may be utilized in other combinations. By way of exemplary disclosure of the best mode of practicing the invention there is shown generally in FIG. 1 a lock 10 containing a bolt 20. The lock 10 comprises a housing 15 containing an interior region 20' with a pair of open ends 24 and 28, a pair of coil springs 30 and 40 separated by a siding washer 50, an exterior face plate 60 which closes the open end 24 and which is held in place by welds 64 and 68. The housing 15 also contains a first and second end plate 70 and 80 and a set of keyway plates 90, 95, 100 and 105. Each of the plates 90, 95, 100 and 105 contains a keyway opening formed along a common center line 107 similar to the opening 620 of the plate 100 shown in FIG. 2 and the bolt 20 passes through these openings.

Inside the coil springs 30 and 40 is a second housing 120 having an interior region or keyway 130. The second housing 120 has an open anterior end 140 which is biased along a line 150 with respect to the rest of the second housing 120. The anterior end 140 of the housing 120 projects through the opening 28 of the housing 15. A flexible key of a type well known in the art such as disclosed in my previously issued U.S. Pat. No. 3,854,312 may be inserted into the housing 120 through the opening at the anterior end 140 for purposes of unlocking the bolt mechanism 20. The open end 28 of the housing 15 is closed by a plate 170 which is held in a position by a weld 180. The plate 170 has a hole 185 through which the end 140 of the housing 120 projects. A cylindrical spacer 190 separates plate 200 from plate 170. The plate 200 which contains a hole 205 is the bearing plate upon which the springs 30 and 40 exert their expansion forces. A second pair of spacers 206, 206' position the end plate 80 with respect to the plates 170 and 200. The key plates 90, 95, 100 and 105 are laterally positioned by a set of spacers 210, 215, 220, 225 and 230. Spacers 210 and 230 are of spring quality material and serve a dual purpose as revealed later in this writing.

The bolt 20 has a centered longitudinal boring 250 which terminates at end 260 and an open end 270 which terminates in a threaded boring 280 which in turn terminates in a non-threaded boring 290. The non-threaded boring 290 terminates at a tapered end 300 of the bolt 20 interior to the region 130. The bolt 20 also has a transverse boring 310 extending through an external surface 320 of the boring 20 and terminating in the boring 250. The bolt 20 has a second transverse boring 330 also extending through the external surface 320. The boring 330 extends through and is perpendicular to the boring 250 and terminates in a shoulder 340. A third transverse boring 350 also perpendicular to the boring 250 has a center of rotation coincident with the center of rotation of the boring 330. The boring 350 extends from the shoulder 340 to an outside surface 360 of the bolt 20. The boring 350 has a smaller diameter than the boring 330. The boring 310 contains a fixed pin 370 which has a first end 380 which extends beyond the surface 320 of the bolt 20 and into a region 390 between the plates 70 and 90. The region 390 is typical of regions between each of the successive pairs of plates 90, 95, 100, 105 and 80. The boring 330 contains a movable pin 400 having an end 410 which extends into the same regions between the plates 90, 95, 100, 105. The pin 400 has a second end 420 formed with a head 425 which has a shoulder 430 and a tapered surface 440. The tapered surface 440 terminates at a point 450. The movable pin 400 acts against a compression spring 460 which is compressed between the shoulder 340 of the bolt and the shoulder 430 of the pin.

The boring 250 contains a compression spring 475 and a sliding member 477. The sliding member 477 is composed of a cylindrical member 480 having first and second parallel surfaces 482 and 484. The member 480 is affixed to a shaft 490 at the surface 484. The shaft 490 is in turn affixed to a cylindrical member 500 at an end surface 505. The member 500 has a tapered or conical surface 510 which is in turn connected to a shaft 520. The shaft 520 is connected to a shaft 530. The shaft 530 has a diameter which corresponds to the diameter of the boring or hole 250. The shafts 490 and 520 have a smaller diameter. The member 480 and the cylindrical portion 500 also have diameters which correspond to the diameter of the hole 250. The surface 482 of the cylindrical member 480 is the bearing surface against which the compression spring 475 exerts its compression force. The shaft 530 has an end 550 which extends into the threaded hole 280.

Figure 2:
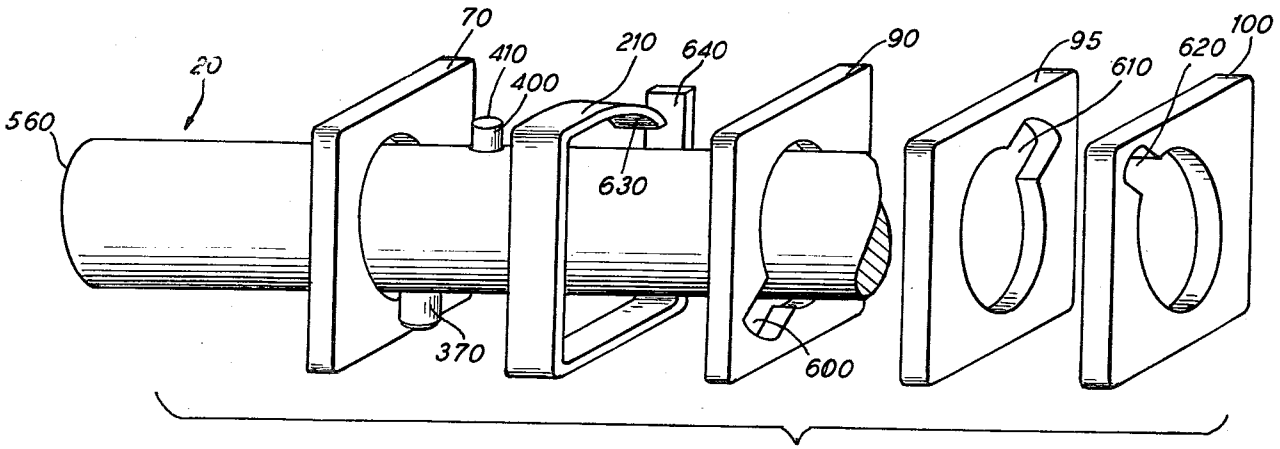
FIG. 2 is a partial exploded view of the spaced locking plates, spring and the improved bolt of the present invention.

The lock 10 of FIG. 1 is shown in the locked position with the bolt 20 having an exterior end 560 which may be latched to a housing of conventional variety to hold a door or other device closed. To unlock the lock 10 it is necessary to retract the bolt 20. The bolt 20 is retracted by inserting a key having a flexible shaft into the keyway 130 of the housing 10 and then further into the hole 290 of the bolt 20. The key is designed in a known fashion to engage the threaded hole 280 of the bolt 20. Once the threaded hole 280 of the bolt 20 has been engaged by the key, the key may press against the end 550 of the shaft 530 of the member 477. By driving the key against the end 550 of the shaft 530 the member 477 may be moved along its axis so as to compress the spring 475. As the member 477 is driven so as to compress the spring 475 the point 450 of the tapered surface 440 of the pin 400 will slide across the cylindrical member 500 until it intersects the tapered surface 510. Upon intersecting the tapered surface 510, the pin 400 will be driven downward toward the shaft 520 under the action of the compressed spring 460. The pin 400 is now fully retracted from the interplate spaces such as the space 390. In this condition only the pin 370 extends into the interplate spaces such as the space 390.

The lock 10 may now be opened by retracting the bolt 20 such that the end 560 no longer engages the strike. With respect to FIG. 2, retraction is accomplished by rotating the bolt 20 so that the pin 370 may first be drawn through a keyway 600 in the plate 90. The bolt 20 is then rotated further so that the pin 370 may now be drawn through a keyway or key slot 610 in the lock plate 95. Finally, the bolt 20 is rotated so that the pin 370 may now be drawn through a keyway 620 of the lock plate 100. It will be understood that as many lock plates and keyways may be incorporated within the housing 15 as desired to give the necessary security and the relationship and angles between the keyways in successive lock plates may be adjusted as desired. It should be noted further that until the pin 400 was retracted so that the end 410 no longer projected into the interplate spaces such as the space 390, the end 560 of the bolt 20 could not be withdrawn from the latching member because both pins 390 and 400 extended into the interplate spaces such as the space 390. As a result, it would be impossible to rotate the bolt 20 so that the two pins 370 and 400 could both simultaneously pass through the keyways 600, 610 and 620.

To resecure the lock 10 the bolt 20 is first rotated under the control of the inserted key so that the pin 370 is repositioned between the plates 70 and 90. The key is then rotated rearwardly until the pin 370 engages the end of stop 630 of the spring grade spacer member 210. The key may then be unscrewed from the threaded hole 280. As the key is unscrewed, the spring 475 which is under compression, forces the member 477 toward the threaded hole 280. For successful operation it is necessary that the spring 475 in the boring 250 is strong enough to overcome the effect of the spring 460 in the hole 330. As the spring 475 drives the member 477 in the direction of the theaded hole 280 the point 450 on the tapered surface 440 rides up the tapered member 510 and engages the cylindrical member 500. When the point 450 engages the cylindrical member 500 the end 410 of the pin 400 is fully extended into the interplate spaces such as the space 390. The bolt mechanism is now locked against movement parallel to its axis.

It should be noted that the pin 370 has an end 650 which acts as a stop for the linear movement of the member 477. As the member 477 is driven toward the spring 475 under the influence of the key in the threaded hole 280 the end 650 of the pin 370 will encounter the surface 505 of the cylindrical member 500 thus preventing any further linear movement of the member 477. As the member 477 is driven toward the threaded hole 280 under the influence of the compression spring 475, the end 650 of the pin 370 will engage the surface 482 of the member 480 thus preventing any further linear movement of the member 470 in a second direction.

Figures 3, 4:
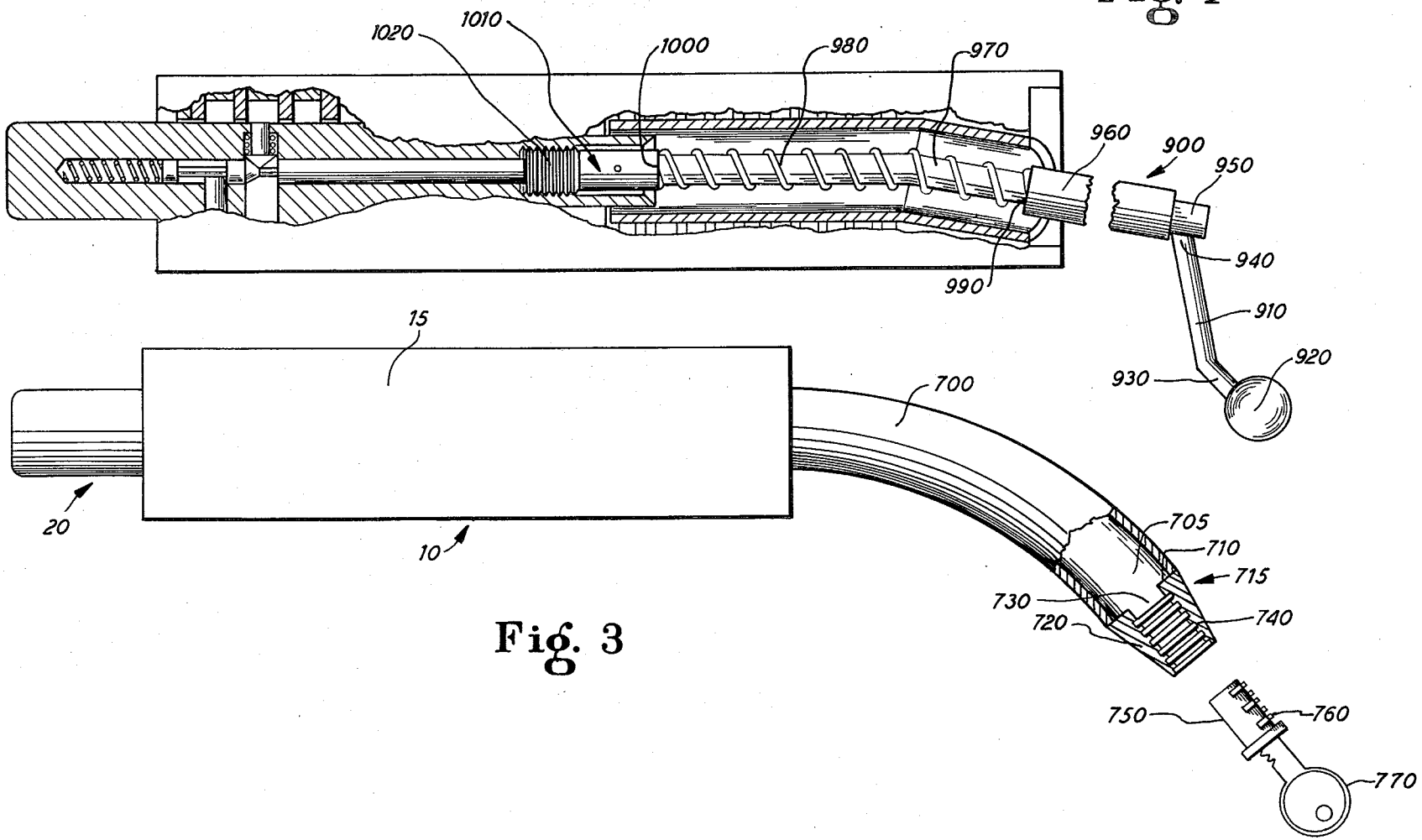
FIG. 3 is a side elevation illustrating a keyway extension and removable cylinder lock.
FIG. 4 is a partially broken away side elevation showing a conventional key inserted into the lock.

A variation on the lock of FIG. 1 is indicated in FIG. 3 where greater security is required. The interior housing 120 of FIG. 1 is extended in FIG. 3 by a curved member 700 having an interior keyway 705 which corresponds to an extension of the keyway 130 of FIG. 1. Attached to an end 710 of the tubular member 700 is a lock mechanism 715. The lock mechanism 715 consists of a housing 720 having an interior keyway 730 with locking ridges 740 of a conventional variety. A removable cylinder lock 750 having locking members 760 may be inserted into the housing 720 to engage locking ridges 740. The effect of the cylinder 750 is to close the end 710 of the housing 700 so that tampering may be avoided as well as to prevent jamming of tube 700 with for example, a willow stick or the like. A key 770 is used to unlock the cylinder lock 750 so that it may be removed from the lock 715.

As shown in FIG. 4, upon removal of the cylinder 750 a conventional key 900 may be inserted into the keyway 705 which mates with the keyway 130. The lock may then be unlocked or locked in the manner previously described. The key 900 has a handle 910 with a ball shaped termination 920 affixed to a first end 930 of the handle 910. A second end 940 of the handle 910 is affixed to a shaft 950. The shaft 950 is affixed to a collar 960 of conventional design. The collar 960 supports a flexible shaft or cable 970 and a spring 980 to prevent cable 970 from ravelling. The shaft 970 has an end 1000 to which is affixed a cylindrical member 1010. The member 1010 has threads 1020 thereon which engage mating threads 280 of the bolt 20 thereby permitting the bolt 20 to be retracted as described previously, as seen in FIG. 1.

Although various modifications might be suggested by those skilled in the art, it should be understood that I wish to embody within the scope of the patent warranted hereon all such modifications as reasonably and properly come within the scope of my contribution to the art.

I claim as my invention:

1. In a lock having a housing, a plurality of locking plates mounted in said housing each having a hole of selected diameter located on a common center line, a plurality of radial slots formed in said locking plates and arranged so as to be misaligned with each other, the improvement comprising a bolt member having:

a fixed transverse pin mounted on said bolt member;

a spring biased movable transverse pin mounted on said bolt member;

means for retraction such that said movable pin may be retracted in order that said bolt member can be angularly displaced to allow said fixed transverse pin to pass through said plurality of radial slots.

2. A lock according to claim 1, with an opening formed in said housing to allow a key to be inserted therethrough with said improved bolt member comprising further a key receiving opening formed in said bolt member operatively aligned with the opening in said housing to allow a key to be inserted into said key receiving opening of said bolt member.

3. A lock according to claim 2, wherein said means for retraction is mounted within said bolt member and which cooperates with the key so as to retract said movable transverse pin.

4. A lock according to claim 3, wherein said movable transverse pin has a first tapered member affixed thereto and wherein said means for retraction comprises a spring-biased means for retraction having a second tapered member which cooperates with said first tapered member affixed to said movable transverse pin such that;

as said spring biased means for retraction is moved in a first direction under the action of the key, said second tapered member cooperates with said first tapered member to allow said spring biased transverse pin to retract thereby permitting linear movement of said bolt;

as said spring biased means for retraction is moved in a direction opposite to said first direction by said biasing spring, said second tapered surface cooperates with said first tapered surface to extend said movable transverse pin thereby rendering said bolt immovable linearly.

5. A lock having a housing, a keyway, a set of keyway plates having radially oriented key slots with a set of holes aligned along a common center line and an improved bolt extending through the holes in said lock plates the improved bolt comprising:

a body member;

a fixed transverse pin mounted on said body member;

a retractable transverse pin mounted on said body member, means for retraction operably connected to said retractable transverse pin and operable to cooperate with a key inserted into the keyway of the housing such that said retractable transverse pin may be substantially retracted within said body member such that said body member may be linearly moved with respect to said housing by aligning said fixed transverse pin with a key slot in a selected one of the set of keyway plates and then sliding said body member, said fixed transverse pin and said means for retraction linearly therethrough.

6. A lock having a housing, a keyway, a set of keyway plates having radially oriented key slots with a set of holes aligned along a common center line and an improved bolt extending through the borings in said lock plates comprising:

a body member with a linear hole therein;

a fixed transverse pin mounted in a transverse boring in said body member;

a spring biased, movable transverse pin mounted on said body member and having a tapered surface;

a spring biased means for retraction comprising a tapered member operably mounted in said linear hole such that said tapered surface of said spring biased transverse pin can slidably engage said tapered member of said spring biased means for retraction to permit said spring biased movable transverse pin to be retracted substantially within said body member by the action of said biasing spring.

7. The lock according to claim 6 wherein said tapered surface of said spring biased movable transverse pin can further slidably engage said tapered member of said spring biased means for retraction to extend said spring biased transverse pin beyond said body member.

8. The lock according to claim 7 with the improvement comprising further a removable means for locking attachable to the keyway whereby said keyway may be locked closed until said removable means for locking has been removed.

9. The lock according to claim 8 wherein said removable means for locking comprises a removable cylinder lock adapted to be unlocked by a key.

* * * * *